United States Patent [19]

McDonald, Jr.

[11] Patent Number: 4,986,018

[45] Date of Patent: Jan. 22, 1991

[54] STABILIZER FOR REDUCING THE EFFECT RESULTING FROM FIRING A FIRING WEAPON

[76] Inventor: Norman J. McDonald, Jr., Rt. 1, Box 155, Hendrix, Okla. 74741

[21] Appl. No.: 19,708

[22] Filed: Feb. 27, 1987

[51] Int. Cl.[5] ..... F41C 27/22

[52] U.S. Cl. ..... 42/1.06; 124/89; 124/92

[58] Field of Search ..... 42/1.06, 74; 124/89, 124/92

[56] References Cited

U.S. PATENT DOCUMENTS

| | | | |
|---|---|---|---|
| 3,290,815 | 5/1965 | Edwards | 42/1.06 |
| 3,300,889 | 1/1967 | Baker | 42/1.06 |
| 3,342,172 | 9/1967 | Sanders | 124/89 |
| 3,381,405 | 5/1968 | Edwards | 42/1.06 |
| 3,408,062 | 10/1968 | Baker | 42/1.06 |
| 3,524,441 | 8/1970 | Jeffery | 124/89 |
| 3,589,350 | 6/1971 | Hoyt, Jr. | 124/89 |
| 3,628,520 | 12/1971 | Izuta | 124/89 |
| 3,670,712 | 6/1972 | Izuta | 124/89 |
| 3,683,534 | 8/1972 | Davis | 42/1.06 |
| 3,683,883 | 8/1972 | Izuta | 124/89 |
| 4,164,825 | 8/1979 | Hutchison | 42/1.06 |
| 4,245,612 | 1/1981 | Finlay | 124/89 |
| 4,279,091 | 7/1981 | Edwards | 42/1.06 |
| 4,491,123 | 1/1985 | Wirtz | 124/89 |
| 4,492,050 | 1/1985 | Kagehiro | 42/1.06 |
| 4,570,608 | 2/1986 | Masterfield | 124/89 |
| 4,615,327 | 10/1986 | Saunders | 124/89 |

OTHER PUBLICATIONS

*Bow & Arrow Hunting,* Feb. 1986, p. 68, "Pro King Hydraulic Stabilizer".

Exhibit A is an advertisement from Saunders/Archery Company.

Exhibit B is an advertisement from Spring Valley Iron Works.

Exhibit C are photographs of the Spring Valley Iron Works Stabilizer.

*Primary Examiner*—Charles T. Jordan

*Assistant Examiner*—Michael J. Carone

*Attorney, Agent, or Firm*—Dunlap, Codding, Peterson & Lee

[57] ABSTRACT

A stabilizer for use with a firing weapon to reduce the effect resulting from firing such firing weapon, the stabilizer having a tube with a first and second end and a tube opening extending a distance therethrough generally between the first and the second ends thereof, and hydraulic fluid being disposed within and substantially filling the tube opening. Closure means substantially closes the first and the second ends of the tube for cooperating to retain the hydraulic fluid within the tube opening and a piston is disposed in the tube opening with the piston being movable in a first direction generally from the first end toward the second end of the tube and in the second direction generally from the second end toward the first end of the tube. A first spring is disposed within the tube opening having one end engageable with one end of the piston and the opposite end engageable with the portion of the closure means closing the first end of the tube. A second spring is disposed within the tube opening having one end engageable with one end of the piston, opposite the end of the piston engaged by the first spring, and an opposite end engageable with a portion of the closure means closing the second end of the tube.

3 Claims, 1 Drawing Sheet

STABILIZER FOR REDUCING THE EFFECT RESULTING FROM FIRING A FIRING WEAPON

BACKGROUND OF THE INVENTION

Field of the Invention

The present invention relates generally to stabilizers and, more particularly, but not by way of limitation, to a stabilizer having a tube filled with hydraulic fluid and a piston disposed within a tube opening in the tube with a first and a second spring engagable with respective opposite ends of the piston.

BRIEF DESCRIPTION OF THE DRAWINGS

FIG. 3 is a front elevational view of a bow with two stabilizers constructed like the stabilizer shown in. FIG. 1 affixed to the bow by way of a bracket.

DESCRIPTION OF THE PREFERRED EMBODIMENTS

Figure 1:
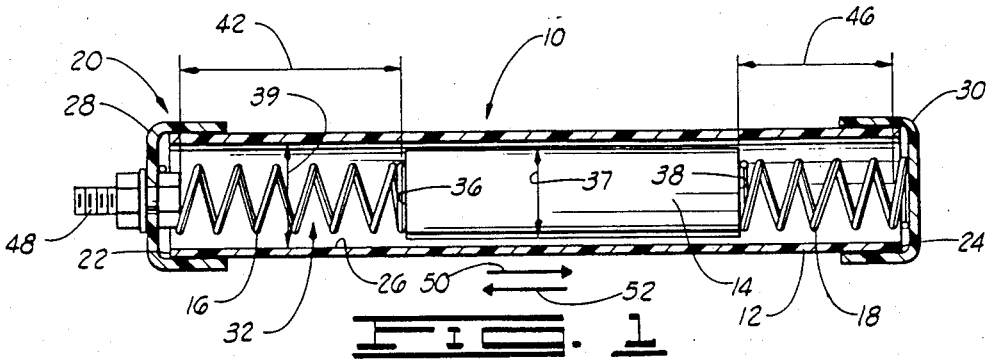
FIG. 1 is a cross sectional view of a stabilizer constructed in accordance with the present invention.

Shown in FIG. 1 and designated therein by the general reference numeral 10 is a stabilizer which is constructed in accordance with the present invention. The stabilizer 10 generally includes a tube 12, a piston 14, a first spring 16, a second spring 18 and a closure assembly 20 for closing the opposite ends of the tube 12. The stabilizer 10 is constructed for use with a firing weapon to reduce the effect resulting from firing such weapon. For example, when an arrow is fired from a bow (the bow being the firing weapon) a recoil action or vibration results and, with the stabilizer 10 affixed to the bow the effect of this recoil action or vibration action substantially is reduced. In a like manner, the stabilizer 10 can be connected to a shotgun (the shotgun being the firing weapon in this instance) to reduce the recoil action or the vibrating action resulting from firing the shotgun.

The tube 12 preferrably is a cylindrically shaped tube having a first end 22 and a second end 24. The tube 12 has a tube opening 26 which preferably is cylindrically shaped and extends a distance through the tube 12 generally between the first and the second ends 22 and 24 of the tube 12. In one preferred form as shown in FIG. 1, the tube opening 26 extends through the tube 12 and intersects the first and the second ends 22 and 24. The tube 12 preferably is constructed of a plastic material, rather than a metal, for reducing noise during the operation of the stabilizer 10.

A first cap 28 is secured to the first end 22 of the tube 12 and the first cap 28 closes the first end 22 of the tube 12 or, more particularly, closes the tube opening 26 generally near the first end 22 of the tube 12. The first cap 28 is press-fitted about a portion of the outer peripheral surface of the tube 12 generally near the first end 22 of the tube 12 and, in one preferred form, the first cap 28 is sealed to the tube 12 by means of a sealant such as sold by United Elchem Industries, Inc. of Dallas, Texas under their trade designation Plastic-weld 703, a multi-purpose cement.

A second cap 30 is secured to the second end 24 of the tube 12 and the second cap 30 closes the second end 24 of the tube 12 or, more particularly, closes the tube opening 26 generally near the second end 24 of the tube 12. The second cap 30 is press fitted about a portion of the outer peripheral surface of the tube 12 generally near the second end 24 of the tube 12 and, in one preferred form, the second cap 30 is sealed to the tube 12 by means of a sealant such as sold by United Elchem Industries, Inc. of Dallas, Texas under their trade designation Plastic-weld 703, a multi-purpose cement.

The first and the second caps 28 and 30 comprise the closure assembly 20 for closing the first and the second ends of the tube 12 or, more particularly, for closing the tube opening 26 generally at the first and the second ends 22 and 24 of the tube 12. The tube opening 26 is substantially filled with a hydraulic fluid 32 and the closure assembly 20 comprising the first and the second caps 28 and 30 cooperate to retain the hydraulic fluid 32 generally within the tube opening 26.

The piston 14 is disposed within the tube opening 26 generally between the first and the second ends 22 and 24. The piston 14 includes opposite ends 36 and 38 and, in one preferred form, the piston 14 is cylindrically shaped and constructed of a metallic material. In one other form, the piston 14 is constructed of a metallic material and coated with a plastic material for further reducing noise during the operation of the stabilizer 10.

The piston 14 preferrably is cylindrically shaped and has a diameter 37 which is smaller than a diameter 39 of the tube 12 to permit the hydraulic fluid to pass between the piston 14 and the tube 12.

The first spring 16 is disposed in the tube opening 26 generally between the end 36 of the piston 14 and the first end 22 of the tube 12. The first spring 16 is metal coil type of spring and has one end which is engagable with the end 36 of the piston 14 and an opposite end which is engagable with the portion of the closure assembly 20 closing the first end 22 of the tube 12 or, more particularly, engagable with a portion of the first cap 28. The first spring 16 has a spring length 42 generally between the opposite ends of the first spring 16.

The second spring 18 is disposed within the tube opening 26 generally between the end 38 of the piston 14 and the second end 24 of the tube 12. The second spring 18 also is preferably a metallic coil type of spring and has one end engagable with the end 38 of the piston 14, opposite the end 36 which is engagable with the first spring 16, and an opposite end which is engagable with a portion of the closure assembly 20 closing the second end 24 of the tube 12 or, more particularly, engagable with the second cap 30. The second spring 18 has a spring length 46 extending generally between the opposite end of the second spring 18. In one preferred embodiment, the spring length 46 of the second spring 18 is shorter than the spring length 42 of the first spring 16 so that the piston 14 is disposed closer to the second end 24 of the tube 12. In some applications, the spring lengths 42 and 46 can be about the same, such as with the firing weapons described below.

Thus, the piston 14, the first spring 16 and the second spring 18 are disposed within the tube opening 26 and the first and the second springs 16 and 18 cooperate to maintain the piston 14 in a position within the tube opening 26 generally between the first and the second ends 22 and 24 of the tube 12. The tube opening 26, as mentioned before, is filled with the hydraulic fluid 32 and the hydraulic fluid 32, more particularly, encompasses the piston 14, the first spring 16 and the second spring 18.

An attachment screw 48 is secured to the first cap 28 and the attachment screw 48 extends a distance from the first cap 8. The attachment screw 48 is sized and adapted to removably secure the stabilizer 10 to some types of firing weapons, such as a bow for example.

In addition to coating the metallic piston 14 with a plastic material, the first and the second springs 16 and 18 also, in one form, are coated with a plastic material to further reduce the noise during the operation of the stabilizer 10.

In assembling the stabilizer 10, the second cap 30 is secured to the second end 24 of the tube 12 and the second spring 18 is inserted within the tube opening 26 and positioned generally adjacent the second cap 30. The piston 14 then is inserted in the tube opening 26 to a position wherein one end of the piston 14 engages one end of the second spring 18. Then, the first spring 16 is inserted in the tube opening 26 to a position to wherein one end of the first spring 16 engages the end 36 of the piston 14. The tube opening 26 is filled with the hydraulic fluid 32, the hydraulic fluid 32 filling the tube opening 26 and surrounding the piston 14 and the first and the second springs 16 and 18 to a position to wherein the upper level of the hydraulic fluid is about three eights of an inch from the first end 22 of the tube 12 in an application where the tube 12 has an overall length generally between the first and the second ends 22 and 24 of about six inches.

After filling the tube opening 26 with the hydraulic fluid 32, the first cap 28 is secured on the end 22 of the tube 12 and the first cap 28 cooperates to pressurize the tube opening 26 as it is pushed over the first end 22 of the tube 12 thereby pushing air into the tube opening 26 for pressurizing the tube opening 26 or more particularly the hydraulic fluid 32 within the tube opening 26. In this particularly embodiment where the overall length of the tube 12 is about six inches, the piston 14 preferably has an overall length of about three inches, the first spring 16 has a spring length 42 of about three and three quarters inches and the second spring 18 has spring length 46 of about one and one half inches. In this embodiment, the diameter of the tube opening 26 is about seven-eights of an inch and the diameter of the piston 14 is about three quarters of an inch so that the diameter of the piston 14 is smaller than the diameter 39 of the tube opening 26 to permit the hydraulic fluid 32 to flow about the outer peripheral surface of the piston 14 during the operation of the stabilizer 10. The hydraulic fluid 32 dampens or slows the reaction of the piston 14 when the firing weapon is fired in reaction to the vibrating or recoil action as a result of firing such firing weapon.

During the operation of the stabilizer 10, the stabilizer 10 is connected to a firing weapon. When the firing weapon is fired, the resulting vibration or recoil action impacts on the stabilizer 10 causing the piston 14 to move in a first direction 50 generally from the first end 22 toward the second end 24 of the tube 12 and in a second direction 52 generally from the second end toward the first end 22 of the tube 12, the movement of the piston 14 and the first and the second directions 50 and 52 being dampened as a result of the hydraulic fluid. Further, the first and the second springs 16 and 18 each cooperate to transfer the action of the movement of the piston 14 of the first and the second direction 50 and 52 to the tube 12, thereby transferring such action to the firing weapon for reducing the recoil or vibrating effect resulting from firing such firing weapon. When the piston 14 moves in the first and second directions 50 and 52, the piston 14, knocks against the walls of the tube 12 resulting in noise. This noise is reduced when the tube 12 is constructed of a plastic material and when the piston 14 is coated with a plastic material as mentioned before.

Figure 2:
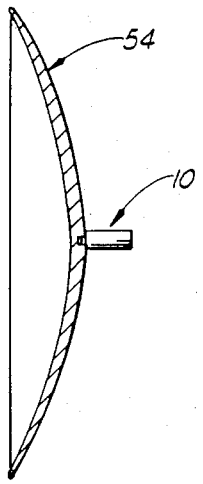
FIG. 2 is a section, diagrammatic view of a bow with the stabilizer of FIG. 1 affixed thereto.

Shown in FIG. 2 is a firing weapon commonly known as a bow, designated in FIG. 2 by the reference numeral 54. The bow 54 is adapted to fire a weapon commonly referred to as an arrow (not shown in the drawings). When the bow string is released by the shooter, the release of the bow string by the shooter results in an action force placed on the bow in the general direction of the string and the stabilizer 10 is intended to reduce the effect of this force. As shown in FIG. 2, the attachment screw 48 is secured within an opening on the forward end of the bow 54, generally between a mid portion thereof and a lower end portion thereof to secure the stabilizer 10 in an operating position on the bow 54. Commercially available professional bows generally include a threaded opening on the forward end of the bow for the securement of a stabilizer and the stabilizer 10 is adapted to utilize this available threaded opening for attaching the stabilizer 10 to the forward end of the bow.

Figure 3:
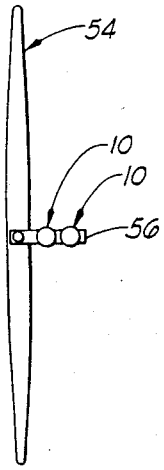

Shown in FIG. 3 is a bow 54 which has two stabilizers 10 attached to the forward end thereof by way of a bracket 56 adapted to accommodate the securing of two stabilizers 10 of the bow 54 which may be desirable in some applications.

Figure 4:
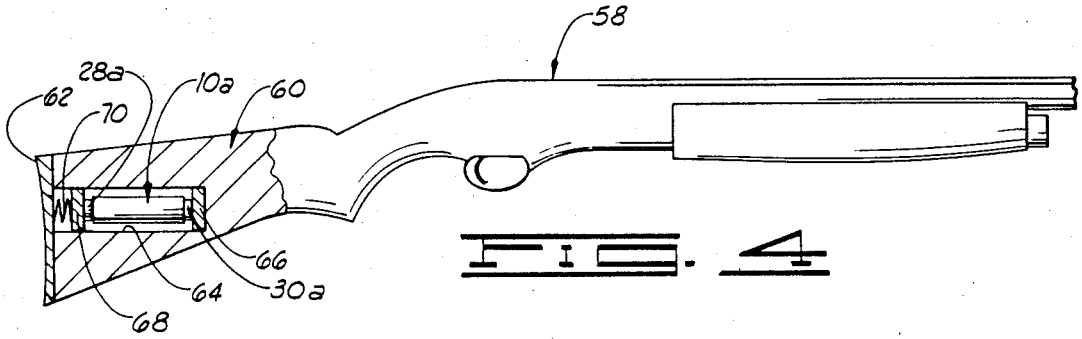
FIG. 4 is a partial sectional, partial elevational, diagrammatic view of a shotgun having a modified stabilizer disposed therein, the modified stabilizer being constructed similar to the stabilizer shown in FIG. 1.

The stabilizer 10 also is constructed and adapted to be utilized in connection with a firing weapon of the type commonly referred to as a rifle or shotgun, a diagrammatic view of a shotgun being shown in FIG. 4 and designated therein by the general reference numeral 58. The shotgun 58 includes a stock 60 having a butt plate 62 secured on the outer most end of the stock 60. A modified stabilizer **10*a* is utilized in connection with the shotgun 58 type of firing weapon and, in this application, an opening 64 is formed in the outer most end of the stock 60 of the shotgun 58**.

The stabilizer **10*a* is constructed exactly like the stabilizer 10 described in detail before, except the stabilizer 10*a* does not include the attachment screw 48 affixed to the first cap 28, since the attachment screw 48 is not needed to affix the stabilizer to the shotgun 58 type of firing weapon, and the caps 8*a* and 30*a* preferrably are fitted inside the tube 12 rather than outside as shown in FIG. 1**.

When installing the stabilizer **10*a* on the shotgun 58, a first pad 66 is first inserted into the opening 64 and disposed generally near one end of the opening 64. The stabilizer 10*a* is then inserted into the opening 64 to a position wherein the second cap 30*a* generally abutts the pad 66, the pad 66 being secured generally between the second cap 30*a* of the stabilizer 10*a* and the stock 60 of the shotgun 58. A second pad 68 then is inserted into the opening 64 to a position wherein the second pad 68 is disposed generally adjacent the first cap 28*a* of the stabilizer 10*a*. A spring 70 then is disposed to the opening 64 to a position wherein the spring 70 engages the second pad 68 and the butt plate 62 then is secured over the end of the stock 60 of the shotgun 58 to close the opening 64, the butt plate 62 engaging one end of the second spring 70. Thus, this application, the stabilizer 10***a* is held within the opening 64 generally between the first and second pads 66 and 68 and the spring 70 cooperates to biasingly hold the stabilizer 10*a* in this position between the first and the second pad 66 and 68. During repeated operations, the pads 66 and 68 may become compressed or deformed so that the stabilizer 10*a* is not held firmly within the openings 64 sole by the pads 66 and 68 and the spring 70 functions to take up any slack caused by any such decompression or deformation of pads 66 and 68 to securely hold the stabilizer 10*a* in an operational position within the opening 64.

Figure 5:
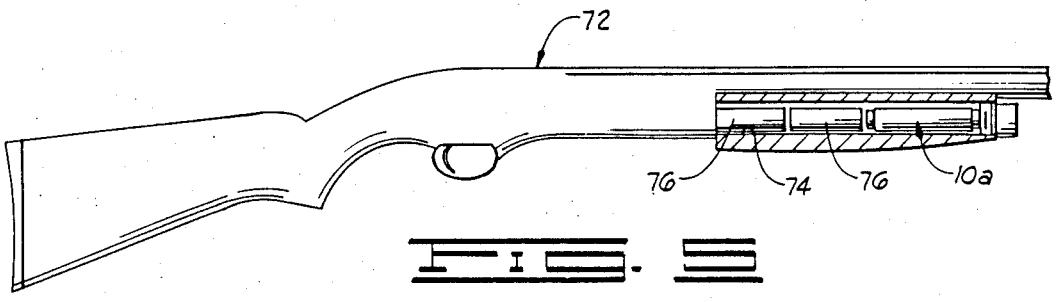
FIG. 5 is a partial section, partial elevational, diagrammatic view of a shotgun showing the modified stabilizer of FIG. 4 disposed in a different location in the shotgun, as compared to the location of the stabilizer shown in FIG. 4.

Shown in FIG. 5 is a shotgun type of firing weapon similar to the shotgun 58 shown in FIG. 4, the shotgun in FIG. 5 being designated by the general reference numeral 72. The shotgun 72 includes an existing opening 74 commonly referred to as a magazine tube where the shotgun shells generally are disposed In this application of the stabilizer 10*a*, the stabilizer 10*a* is inserted within the opening 74 in a manner exactly like that described before with respect to the assembly of the stabilizer 10*a* in the opening 64 of the shotgun 58 shown in FIG. 4. The stabilizer 10*a* will operate in cooperation with the shotgun 72 in a manner exactly like that described before in connection with the shotgun 58 shown in FIG. 4, except FIG. 5 illustrates one different location for the stabilizer 10*a* for use with a shotgun type of firing weapon.

With respect to the shotgun 72 shown in FIG. 4, the stabilizer 10*a* is inserted into the opening 74 and shotgun shells also are inserted into the opening 74, two shotgun shells being shown in FIG. 4 and designated therein by the reference numeral 76.

It should be noted that the term "shotgun" as been utilized herein to describe one type of firing weapon and the stabilizer 10*a* also can be used to utilized in connection with a firing weapon of the type generally referred to as a "rifle" as opposed to a shotgun. The term "arm held gun" is used herein to encompass a military type of permanently or semi-permanently mounted or ground mounted type of firing weapon and both a rifle type of firing weapon and a shotgun type of firing weapon, as opposed to a "hand held" type of fire arm.

It should be noted that the stabilizer could include two pistons disposed between the first and the second springs with a third spring disposed between the two pistons.

It should be noted that the components of the stabilizer 10*a* do not have to be constructed of a plastic material since noise is not as significant with respect to an arm held gun type of firing weapon as opposed to a hand held type of firing weapon.

Changes may be made in the various components, elements or assemblies described herein without departing from the spirit and scope of the invention as defined in the following claims.

What is claimed is:

1. A stabilizer for use with a bow to reduce the effect resulting from firing such bow, comprising:

a tube having a first end and a second end and a tube opening extending a distance therethrough generally between the first and the second ends thereof, a hydraulic fluid being disposed within and substantially filling the tube opening;

closure means for substantially closing the tube opening generally at the first and the second ends of the tube for cooperating to retain the hydraulic fluid within the tube opening;

a piston disposed in the tube opening and having opposite ends, the piston being movable in a first direction generally from the first end toward the second end of the tube and in a second direction generally from the second end toward the first end of the tube, the tube being constructed of a nonmetallic plastic material for reducing noise during the operation of the stabilizer;

a first spring disposed within the tube opening having one end engageable with one end of the piston and an opposite end engagable with a portion of the closure means closing the tuber opening generally at the first end of the tube, the first spring being a metal, coil type spring coated with a plastic material for further reducing noise during the operation of the stabilizer;

a second spring disposed within the opening having one end engagable with one end of the piston, opposite the end engagable with the first spring, and an opposite end engagable with a portion of the closure means closing the tube opening generally at the second end of the tube and, the second spring being a metal, coil type spring coated with a plastic material for further reducing noise during the operation of the stabilizer;

means for removably securing the tube to the bow.

2. The stabilizer of claim 1 wherein the first spring is defined further as opposite ends of the spring and wherein the second spring is defined further as having a spring length generally between the opposite ends of the spring, the spring length of the second spring being shorter than the spring length of the first spring so the piston is positioned generally closer to the second end of the tube as compared to the distance between the piston and the first end of the tube.

3. The stabilizer of claim 1 wherein the tube opening in the tube is defined further as having a diameter and wherein the piston is defined further as having a diameter, the diameter of the piston being smaller than the diameter of the tube opening to facilitate the flow of hydraulic fluid generally about the outer peripheral surface of the piston.

* * * * *

UNITED STATES PATENT AND TRADEMARK OFFICE
CERTIFICATE OF CORRECTION

PATENT NO. : 4,986,018

DATED : January 22, 1991

INVENTOR(S) : Norman J. McDonald, Jr.

It is certified that error appears in the above-identified patent and that said Letters Patent is hereby corrected as shown below:

Column 4, line 54, the word "8a" should be --28a--.

Column 6, line 27, the word "tuber" should be --tube--.

Signed and Sealed this

Fifteenth Day of September, 1992

*Attest:*

DOUGLAS B. COMER

*Attesting Officer*

*Acting Commissioner of Patents and Trademarks*